United States Patent [19]

Zimmern et al.

[11] 4,261,691

[45] Apr. 14, 1981

[54] ROTARY SCREW MACHINE WITH TWO INTERMESHING GATE ROTORS AND TWO INDEPENDENTLY CONTROLLED GATE REGULATING VALVES

[75] Inventors: Bernard Zimmern, Neuilly, France; Guy F. Hundy, Gravesend, England

[73] Assignee: Hall-Thermotank Products Limited, Dartford, England

[21] Appl. No.: 21,817

[22] Filed: Mar. 19, 1979

[30] Foreign Application Priority Data

Mar. 21, 1978 [GB] United Kingdom ..... 11094/78

[51] Int. Cl.[3] ..... F04B 49/02; F01C 1/12; F01C 21/12; F04C 29/08

[52] U.S. Cl. ..... 417/440; 418/195; 418/196

[58] Field of Search ..... 418/159, 195, 196; 417/440, 310

[56] References Cited

U.S. PATENT DOCUMENTS

| | | | |
|---|---|---|---|
| 1,989,552 | 1/1935 | Good | 418/195 |
| 3,205,874 | 9/1965 | Renshaw | 418/195 |
| 3,756,753 | 9/1973 | Persson et al. | 418/159 |
| 4,028,016 | 6/1977 | Keijer | 418/195 |
| 4,043,704 | 8/1977 | Zimmern | 418/195 |
| 4,074,957 | 2/1978 | Clarke et al. | 418/195 |

*Primary Examiner*—John J. Vrablik
*Attorney, Agent, or Firm*—Michael J. Striker

[57] ABSTRACT

This invention relates to a rotary fluid machine (e.g. a compressor) of the single screw type, the single screw cooperating with rotary toothed gate rotors to define fluid-filled chambers whose volumes vary as the screw rotates. The invention is concerned with the provision of two or more capacity-regulating valves provided for the chambers of such a machine, the operating members of such valves being arranged such that one member can be moved independently of the other or others.

3 Claims, 4 Drawing Figures

PRIOR ART

FIG.2.
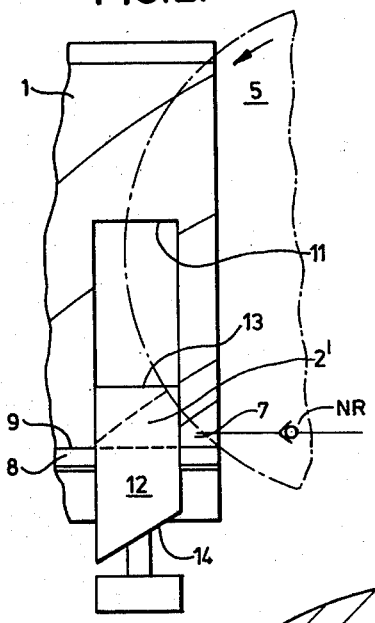
FIG.3.
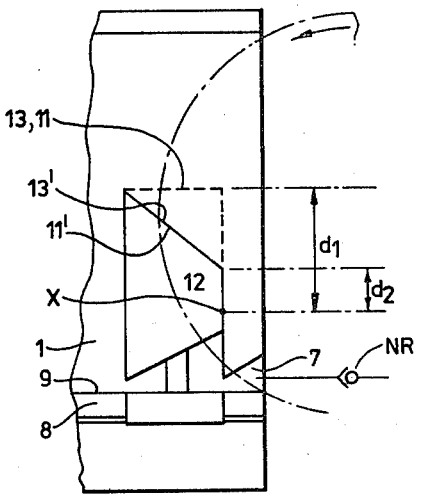
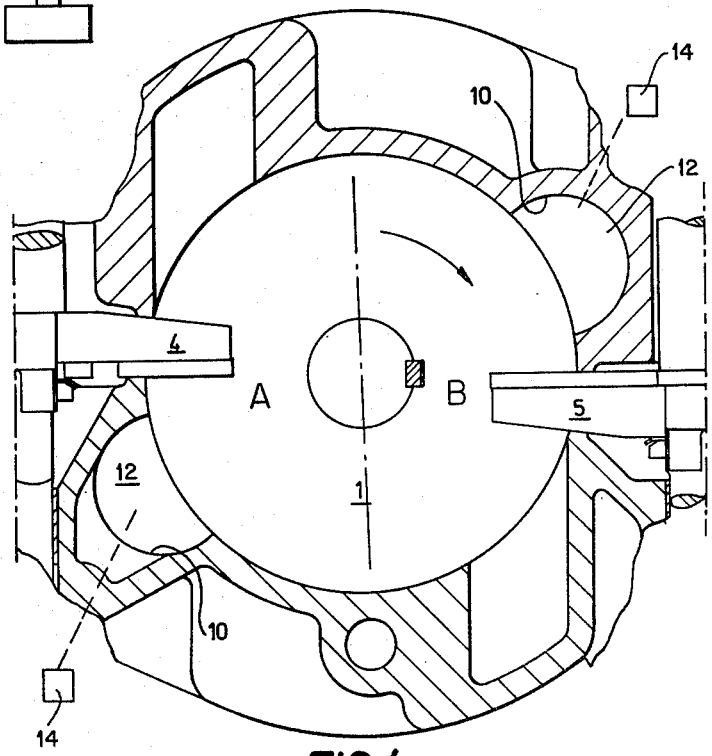
FIG.4.

ROTARY SCREW MACHINE WITH TWO INTERMESHING GATE ROTORS AND TWO INDEPENDENTLY CONTROLLED GATE REGULATING VALVES

BACKGROUND OF THE INVENTION

This invention relates to an improvement in a rotary fluid machine, of the single screw, gate rotor type which may be employed as a compressor, a motor or a pump.

Our prime interest is with regard to signle screw, multi-gate rotor machines when used as compressors (e.g. for compressing air or a refrigerant vapour or gas) and for simplicity, this specification thereafter refers to the mode of use in which compressible fluid is fed to the machine through a low pressure inlet port and is exhausted from the machine at a higher pressure through an outlet port. It should be appreciated, however, that it is believed that the invention applies equally to alternative modes of operation in which the machine is used to generate kinetic energy from a fluid supplied at high pressure (i.e. operation as a motor).

This invention is specifically concerned with rotary fluid machines of the kind comprising a screw rotatable about an axis and having surface grooves formed therein which are inclined relative to that axis, the lands, serving to separate the grooves one from another, making sealing engagement with a surrounding casing whereby each groove defines a chamber with the casing, during at least a part of the rotation of the screw within the casing, a gate rotor having teeth which intermesh with the grooves of the screw, each tooth being successively in sealing relationship with the grooves as the intermeshing screw and rotor rotate, the volume of any chamber defined by a groove and limited at one end by a rotor tooth changing from a maximum to a minimum as the screw and rotor rotate, a high pressure port in the casing adjacent to a high pressure end of the screw and communicating with each chamber when the latter is at, or adjacent to, its minimum volume and a low pressure port at a low pressure end of the screw and communicating with each chamber. Hereafter, throughout this specification a rotary fluid machine of the kind just described, will be referred to as a "rotary fluid machine of the kind specified".

Typically a rotary fluid machine of the kind specified would have two gate rotors disposed diametrically with respect to the screw, there being low and high pressure ports associated with each gate rotor.

When a rotary fluid machine of the kind specified is used as a compressor, fluid to be compressed is supplied through the low pressure port. The geometry of the intermeshing screw and rotor(s) together with the size of the high pressure port(s), would be selected to give a desired volume ratio (i.e. ratio between the volume of the chamber when filled with fluid at the pressure existing in the low pressure port and when communication with that port has just ceased, to the volume of the chamber when that chamber first communicates with the high pressure port) but in many applications it is desirable to be able to modify the capacity of the machine (i.e. to modify the volume of gas compressed to the desired volume ratio per unit time) without altering (to any appreciable extent) the speed of rotation of the intermeshing screw/rotor(s) and without seriously modifying the designed volume ratio.

If the volume ratio is allowed to fall and the machine is working across a fixed pressure difference, the compression becomes inefficient resulting in reduced efficiency at part load. A rise in volume ratio is even less desirable because in addition to the power lost in overcompressing the gas, the higher pressures occurring give rise to corresponding higher leakage losses.

To this end, it has been proposed in the specification of U.S. Pat. No. 4,074,957 of Clarke et al (hereafter referred to as the former specification) to provide a capacity-regulating valve in the casing adjacent to the high pressure side of the or each gate rotor, said or each said valve including a channel which communicates with the grooves and extends beyond the high pressure end of the screw, the channel being provided with a movable capacity-regulating member which in one limiting position obturates the one end of said channel which is remote from the high pressure end of the screw while leaving a region of said channel open adjacent said high pressure end and in the other limiting position extends beyond the high pressure end of the screw and leaves open the channel at the said one end. Suitably the said one end of the channel is located at a point intermediate the low and high pressure ends of the screw.

Using a capacity-regulating valve as described in the former specification, it is possible to provide a machine having a facility for modifying the capacity continuously from 100% to 25% with a reduced variation in the volume ratio occurring throughout that adjustment range.

However, when using the arrangement described in the former specification, even the reduced variation in volume ratio may be excessive and this invention relates to an improved arrangement which in preferred embodiments enables large capacity reductions to be effected with further reduced variations in volume ratio.

SUMMARY OF THE INVENTION

According to the present invention a rotary fluid machine as claimed in the former specification and having more than one gate rotor, and thus more than one capacity-regulating valve, is provided with control means which can be used to move the control member of one capacity-regulating valve independently of the other or others.

By providing the capacity control means with a facility which permits one capacity-regulating valve to be operated independently of the other, or others, it is possible to have the valves differently set and obtain an overall percentage reduction of capacity for the machine which is a combination of the different capacities set on the valves. Thus an overall 50% capacity on a two-rotor machine can be the result of having one valve fully open and the other fully closed or a 75% capacity can be obtained by having one valve half open and the other valve fully closed.

The control means can provide stepless adjustment of one or more of the valves but since in many refrigeration applications, stepped unloading is quite acceptable, stepped adjustment of each valve between end positions and one or more intermediate positions will commonly suffice and will permit simplification of the control means.

In general, it will be necessary to isolate the outputs from the different regulating valves and this can achieved by a suitable design of the valves or by the inclusion of a non-return valve in the high pressure discharge passage communicating with the outlet ports of each valve.

BRIEF DESCRIPTION OF THE DRAWING

The invention will now be further described by way of example with reference to the accompanying drawings, in which

FIG. 2 shows just the slide of FIG. 1 in the full-open position with a non-return valve in the exhaust duct, FIG. 3 shows a modified form of slide for use in the machine of FIG. 1, and FIG. 4 is a cross-section of part of the machine of FIG. 1 showing the screw and gate rotors and two capacity-regulating valve elements and the separate control means therefor.

DESCRIPTION OF THE PREFERRED EMBODIMENTS

Figure 1:
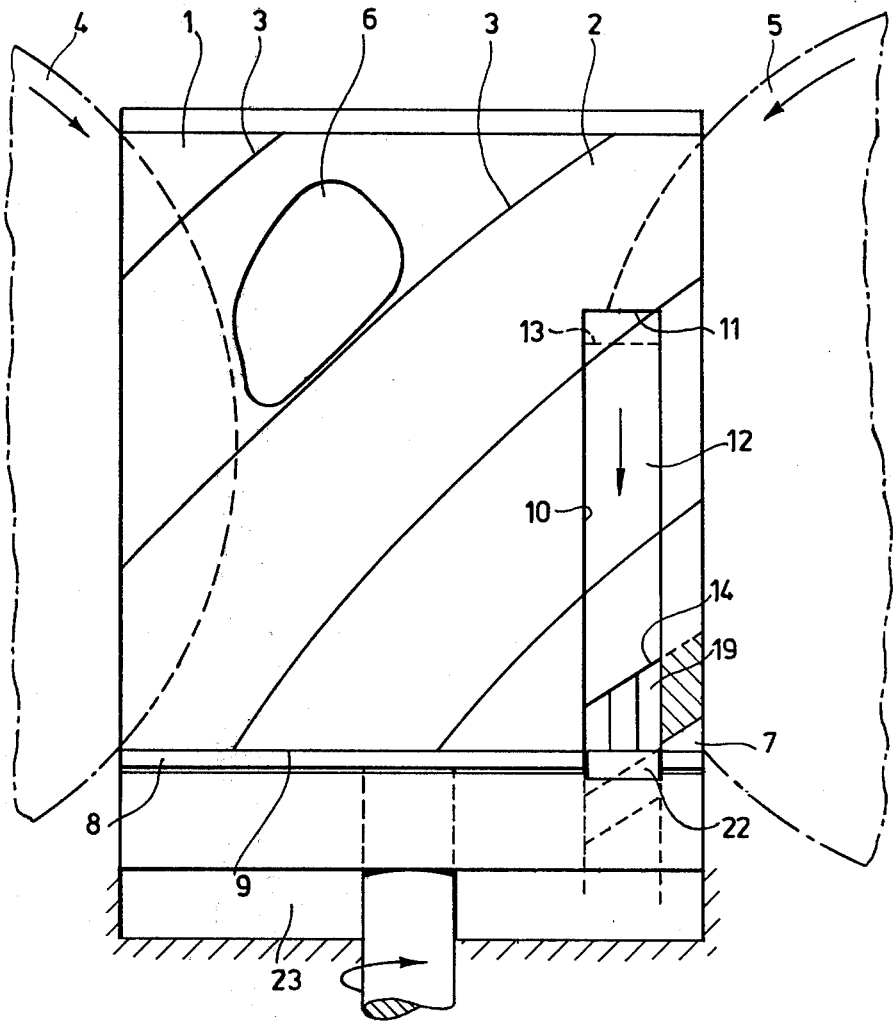
FIG. 1 is a schematic view of part of a single screw twin rotor machine as described in the former specification showing one of the capacity-regulating members in the fully-closed position.

Referring to FIG. 1 (which is reproduced from the former specification) and 4, there is shown a screw 1 having a generally circular cylindrical outer surface and provided with a plurality of helically inclined grooves 2 which are defined between lands 3, it being the radially outer surfaces of the lands 3 which, in the main, define the cylindrical shape of the screw 1. The screw 1 is in mesh with two gate rotors 4 and 5. These gate rotors are each provided with teeth (not shown) which locate in the grooves 2 and, as the screw 1 rotates in a cylindrical cavity in a surrounding casing (shown in FIG. 4), cause the volume of the grooves 2 defined between adjacent lands 3, the casing and the appropriate tooth of the gate rotor 4 or 5, to reduce from a maximum in which the groove is in contact with gas flowing through a low pressure inlet port 6 to a minimum when the gas compressed in the groove 2 is first released to a high pressure outlet port 7.

Single screw, twin gate rotor compressors of the kind described are sufficiently well known to make more detailed description of the mode of operation unnecessary.

The end of the screw 1 shown lowermost in FIG. 1, has an un-grooved narrow cylindrical high pressure end region 8 which is closely surrounded by the cylindrical casing. This means that each groove terminates approximately on the line 9, the teeth of each gate rotor ceasing to make contact with the screw 1 as each tooth moves through the plane normal to the rotating axis of the screw 1 that contains the line 9. This line 9 therefore represents the high pressure end of the screw.

To permit control to be exercised over the capacity of the compressor illustrated (in the manner claimed in the former specification), the casing is provided with a valve channel 10 which is disposed parallel to the axis of the screw 1 and extends from end 11 located (pressure-wise) intermediate the low pressure port 6 and the high pressure port 7 (which includes the recess 19) beyond the line 9 and thus beyond the high pressure end of the screw 1. The channel 10 extends beyond the entire cylindrical region 8.

Slidably located in each channel 10 is a capacity-regulating member 12, the member 12 having an end surface 13 which can make fluid-tight contact with the end 11 of the channel 10. The member 12 defines a recess 19 limited in one direction by an end surface 14 of arcuate shape chosen to conform with the shape of the lands 3 in that region closest to the cylindrical region 8 of the screw 1 and limited in the opposite direction by a portion 22 which serves to prevent the passage of gas between the recess 19 and a low pressure region 23.

The manner in which the member 12 acts to vary the capacity and at the same time do something to compensate for falling volume ratio is fully described in the former specification and all that need be mentioned here is that the end surface 13 delays the onset of compression as it is moved away from the end 11 and the end surface 14 effects a simultaneous reduction in the size of the outlet port thereby delaying the moment at which the compressed fluid in the groove is released from the groove.

Any convenient mechanism shown schematically at 14 in FIG. 4 can be used to move the capacity-regulating members either steplessly or between preset adjustment positions. As described in the former specification they can be ganged together and moved together.

By operating the capacity-regulating members independently improvements in performance can be obtained. Thus, if one side of a twin gate rotor machine (which is effectively two compressors in parallel) were to be isolated and run at 0% capacity, the machine would give 50% of its rated capacity at an efficiency which is substantially that of, and at a volume ratio which is the same as that of, the full load value whereas the efficiency, when the two compressors are operating in parallel at 50% each, is some 20% worse than the efficiency at full load. This improvement is due to the fact that completely eliminating one of the two compressors eliminates most of its losses, and particularly the leakage losses that, at part load, become quite considerable.

A simple way of achieving this with the design of member 12 discussed above, is to move the member 12 on one side (side A) first, completely reducing the volume throughput to zero on that side before starting to move the member 12 on side B.

A check valve NR or non-return valve located in the discharge passageway on the side A blocking fluid flow in the direction towards the port 7 at side A would isolate that side from the discharge pressure appearing on the side B. This diminishes the leakage losses associated with side A of the machine.

Depending on how far the member 12 moved there would be some compression of the gas in the chamber formed by the residual part of the groove chamber (2') together with the volume of the discharge gallery between the port and the check valve. This compression is due to the volume reduction of the last part of the groove chamber just before it "disappears" at the high pressure end of the screw and there would be a subsequent re-expansion of this gas when the reset groove became exposed to the port 7.

The pressure rise which appears in this residual part of the groove chamber 2' will depend on the volume of the groove chamber at the cut-off position shown in FIG. 2 and the volume of the discharge gallery between the port and the check valve. The pressure rise, and hence the losses incurred can be minimised by decreasing this minimum groove chamber volume and/or by increasing the volume of the discharge gallery. The minimum groove chamber volume is less if the slide travel is greater, so that the cut off point moves further down in FIG. 2.

The actuation and control means 14 for stepless capacity reduction would be more complex in the case of a machine in accordance with this invention than in the case of a machine as described in the former specification where the slides move together, but simplifications may easily be made if step unloading is acceptable.

For example consider the case where side A operates only at 100% load and zero load, and side B operates only at 100% load or 50% load. Three steps of unloading are possible with independent movement of the two members 12; with side B alone (75%); side A alone (50%); and both (25%). The advantages are 1. simpler actuator control.
2. reduced travel of the members 12 can be tolerated, because the position and shape of the edge 11, and hence the matching edge 13, can be specifically designed for the zero load condition on side A, and side B only requires to move to the 50% position.
3. The valve on side B can be designed to give a good compromise on volume ratio specifically at the 50% load condition and hence at all three stages of unloading the volume ratio can be kept very close to the optimum.

With regard to advantage 2 listed above, FIG. 3 shows a modified form of valve in which the end 11 and end surface 13 are angled at 11', 13'. If it is necessary to move the end surface 13 of the member 12 to the point X to produce 50% capacity, a travel distance $d_1$ is required using a normal end surface 13 but only a travel distance $d_2$ if an inclined end surface 13' is employed.

Although the specific description has featured a screw of circular cylindrical outer shape and flat gate rotors these are not to be considered as limitations of the invention, which is equally applicable to screws of conical or other outer configuration, and other types of gate rotor, for example where the teeth of the gate rotor are disposed on a cylinder.

What is claimed as new and desired to be protected by Letters Patent is set forth in the appended claims:

1. In a rotary fluid machine of the kind comprising a screw rotatable about an axis and having surface grooves formed therein which are inclined relative to that axis, the lands, serving to separate the grooves one from another, making sealing engagement with a surrounding casing, during at least a part of the rotation of the screw within the casing, two gate rotors, each gate rotor having teeth which intermesh with the grooves of the screw, each tooth in each gate rotor being successively in sealing relationshipwith the grooves as the intermeshing screw and rotor rotate, the volume of any chamber defined by a groove and limited at one end by a rotor tooth changing from a maximum to a minimum as the screw and gate rotor rotate, a high pressure port in the casing adjacent to a high pressure end of the screw and communicating with each chamber when the latter is at, or adjacent to, its minimum volume and a low pressure port at a low pressure end of the screw and communicating with each chamber, a capacity-regulating valve in the casing adjacent to the high pressure side of each gate rotor, each said valve including a channel which communicates with the grooves and extends beyond the high pressure end of the screw, each channel being provided with a movable capacity-regulating member, which in one limiting position obturates the one end of said channel which is remote from the high pressure end of the screw while leaving a region of said channel open adjacent said high pressure end and in the other limiting position extends beyond the high pressure end of the screw and leaves open the channel at the said one end, the provision of control means operatively associated with each capacity-regulating member to permit the capacity-regulating member of one capacity-regulating valve to be moved independently of the other capacity-regulating member, and a non-return valve in the high pressure discharge passage communicating with the outlet port of at least one of said capacity-regulating valves, said non-return valve being adjacent to the outlet port and blocking fluid flow in the direction towards said outlet port.

2. A machine as claimed in claim 1 in which the control means provides stepless adjustment of at least one of the capacity-regulating members of the capacity-regulating valves.

3. A machine as claimed in claim 1, in which the control means permits stepped adjustment of at least one of the capacity-regulating members of the capacity-regulating valves.

* * * * *